US008435141B2

(12) United States Patent
Harris et al.

(10) Patent No.: US 8,435,141 B2
(45) Date of Patent: May 7, 2013

(54) TENNIS BALL MANAGEMENT SYSTEM

(76) Inventors: Joshua Robert Harris, Lakewood Village, TX (US); Omar R. Torres, Little Elm, TX (US)

( * ) Notice: Subject to any disclaimer, the term of this patent is extended or adjusted under 35 U.S.C. 154(b) by 48 days.

(21) Appl. No.: 13/162,387

(22) Filed: Jun. 16, 2011

(65) Prior Publication Data

US 2012/0322589 A1 Dec. 20, 2012

(51) Int. Cl.
*A63B 61/00* (2006.01)
*A63B 69/38* (2006.01)

(52) U.S. Cl.
USPC ..... 473/460; 473/494

(58) Field of Classification Search ..... 473/459, 473/460, 494
See application file for complete search history.

(56) References Cited

U.S. PATENT DOCUMENTS

| | | | | |
|---|---|---|---|---|
| 2,615,715 | A * | 10/1952 | Moore | 473/495 |
| 4,886,268 | A * | 12/1989 | Langslet | 473/492 |
| 4,919,421 | A | 4/1990 | Vandeveld | |
| 6,277,039 | B1 * | 8/2001 | Kleinschrodt | 473/460 |
| 6,758,770 | B2 * | 7/2004 | Chandronnait | 473/494 |
| 2003/0073519 | A1 * | 4/2003 | Shau | 473/460 |
| 2004/0110579 | A1 * | 6/2004 | Chandronnait | 473/490 |

* cited by examiner

*Primary Examiner* — Raleigh W. Chiu
(74) *Attorney, Agent, or Firm* — Yee & Associates, P.C.

(57) ABSTRACT

A method and apparatus comprising a net, a set of lines, and a support system. The set of lines is associated with the net. The support system is configured to be connected to posts on a tennis court. The support system is further configured to be connected to the set of lines. The support system is further configured to change a tension in the set of lines. The net is configured to catch a tennis ball striking a tennis net on the tennis court when a desired amount of tension in the set of lines is present.

8 Claims, 10 Drawing Sheets

TENNIS BALL MANAGEMENT SYSTEM

BACKGROUND INFORMATION

1. Field

The present disclosure relates generally to tennis and, in particular, to tennis courts. Still more particularly, the present disclosure relates to a method and apparatus for managing tennis balls.

2. Background

Tennis is a sport usually played between two players or two teams of two players. A tennis ball is hit by rackets, used by the players, over a net on a court. During game play and practice, a player may not be able to hit the tennis ball to a desired location. In some cases, the tennis ball may hit the net rather than going over the net. In these situations, the tennis ball may roll on the court after hitting the net.

During practice, the number of balls that may hit a net may be such that a player may be unable to concentrate on the practice because of the attention that needs to be given to the balls on the court in order to avoid injuries. As a result, the practice or game play may need to be temporarily halted to remove the tennis balls from the court. Otherwise, a player may be distracted from properly hitting the ball when looking for balls on the court, or a player may injure themselves if they step on a ball inadvertently.

Therefore, it would be advantageous to have a method and apparatus that takes into account at least some of the issues discussed above, as well as other possible issues.

SUMMARY

In one advantageous embodiment, an apparatus comprises a net, a set of lines, and a support system. The set of lines is associated with the net. The support system is configured to be connected to posts on a tennis court. The support system is further configured to be connected to the set of lines. The support system is further configured to change a tension in the set of lines. The net is configured to catch a tennis ball striking a tennis net on the tennis court when a desired amount of tension in the set of lines is present.

In another advantageous embodiment, a tennis ball management system comprises a net, a set of lines, a crank, and a set of rods. The set of lines is associated with the net. The crank is configured to be connected to one of posts for a tennis net. The crank is further configured to be connected to the set of lines. The crank is further configured to change a tension in the set of lines. The net is configured to catch a tennis ball striking the tennis net connected to the posts on a tennis court when a desired amount of tension in the set of lines is present. Each rod in the set of rods is configured to connect to a first side of the net and a second side of the net and maintain a desired amount of space between the first side of the net and the second side of the net when the desired amount of tension in the set of lines is present.

In yet another advantageous embodiment, a method for managing tennis balls is provided. A tennis ball is received at a tennis net. The tennis ball received at the tennis net is caught in a tennis ball management system. The tennis ball management system comprises a net, a set of lines associated with the net, and a support system. The support system is configured to be connected to posts on a tennis court, be connected to the set of lines, and change a tension in the set of lines. The net is configured to catch the tennis ball striking a tennis net on the tennis court when a desired amount of tension in the set of lines is present.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives and advantages thereof, will best be understood by reference to the following detailed description of an advantageous embodiment of the present disclosure when read in conjunction with the accompanying drawings, wherein:

DETAILED DESCRIPTION

The illustrative embodiments recognize and take into account a number of different considerations. In some cases, other individuals may be present to retrieve the tennis balls for the players. However, retrievers for tennis balls may not always be available.

For example, the illustrative embodiments recognize and take into account that having individuals retrieve balls that may have hit a net on a tennis court may not always be feasible. In some cases, a person may not be available or the cost may be more than desired.

The different advantageous embodiments provide an apparatus to manage balls on a tennis court. The apparatus comprises a net, a set of lines associated with the net, and a support system. The support system is configured to support the net such that the net catches a tennis ball striking a tennis net on the court.

Figure 1:
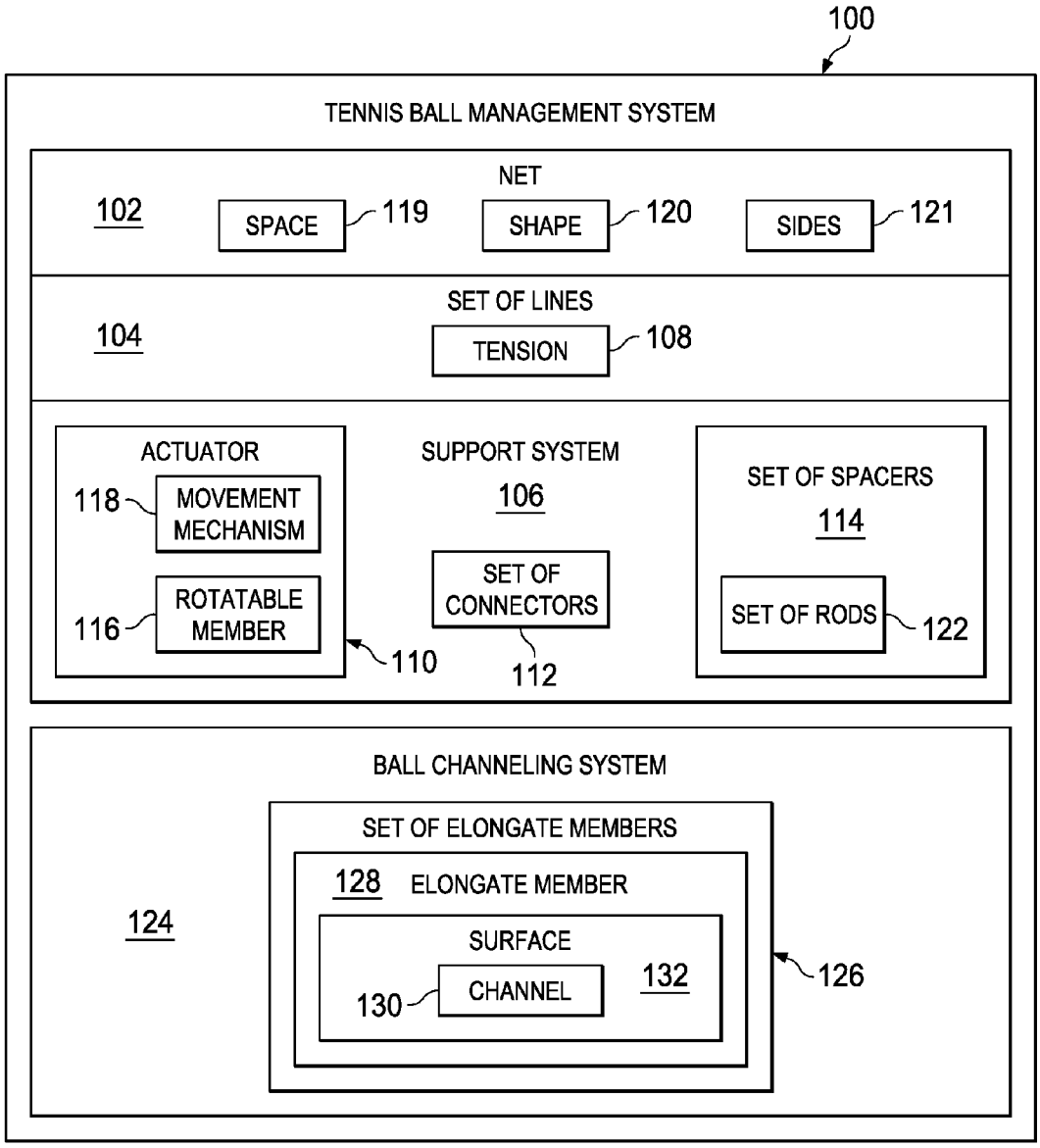
FIG. 1 is an illustration of a block diagram of a tennis ball management system in accordance with an advantageous embodiment.

With reference now to FIG. 1, an illustration of a block diagram of a tennis ball management system is depicted in accordance with an advantageous embodiment. As depicted, tennis ball management system 100 comprises net 102, set of lines 104, and support system 106. Set of lines 104 is associated with net 102. "A set", as used herein with reference to items, means one or more items. For example, "a set of lines" may be one or more lines.

A first component may be considered to be associated with a second component by being secured to the second component, bonded to the second component, welded to the second component, fastened to the second component, and/or connected to the second component in some other suitable manner. The first component also may be connected to the second component using a third component. The first component also may be considered to be associated with the second component by being formed as part of and/or an extension of the second component.

Support system 106 is configured to be connected to posts on a tennis court and set of lines 104. Support system 106 is configured to change tension 108 in set of lines 104. By changing tension 108, net 102 may be configured in conjunction with support system 106 to catch a tennis ball striking the tennis net on a tennis court when a desired amount of tension 108 is present in set of lines 104.

In this illustrative example, net 102 may be implemented using any suitable type of net or material that may be configured to catch a tennis ball in support system 106. In these illustrative examples, net 102 may be made from the same type of net used for tennis nets. Of course, other types of nets or materials may be used. These materials may include, for example, without limitation, nylon, plastic, and other suitable materials that may be flexible.

In these illustrative examples, support system 106 may comprise actuator 110, set of connectors 112, and set of spacers 114. These components are illustrated in a functional form to describe different features for different illustrative embodiments.

As depicted, actuator 110 is configured to change tension 108 in set of lines 104. Actuator 110 may take various forms. For example, actuator 110 may have rotatable member 116 and movement mechanism 118. Rotatable member 116 may be connected to set of lines 104 to generate tension 108. Movement mechanism 118 is configured to move rotatable member 116 to change tension 108 in set of lines 104.

Movement mechanism 118 may take various forms. For example, movement mechanism 118 may be an arm that may be connected to rotatable member 116. This arm may be moved by a human operator to rotate rotatable member 116. In other illustrative examples, movement mechanism 118 may be a motor that is configured to rotate rotatable member 116. In these illustrative examples, actuator 110 is connected to set of lines 104 such that actuator 110 may change tension 108 of set of lines 104.

One portion of set of lines 104 is connected to actuator 110, while another portion of set of lines 104 is connected to set of connectors 112. In these examples, the portions are the ends of the lines in set of lines 104.

Set of connecters 112 may be made from various materials. For example, the connectors may be made from metal, aluminum, steel, plastic, or other materials suitable for connection to set of lines 104. When two lines are used in set of lines 104, each line may be about 45 feet long.

In these illustrative examples, actuator 110 may be connected to one post on a tennis court for a tennis net. Set of connectors 112 may be connected to another post for the tennis net.

A portion of set of lines 104 may be connected to set of connectors 112 in a number of different ways. For example, an end of a line in set of lines 104 may be tied to, or otherwise secured to, a connector in set of connectors 112. In other illustrative examples, a connector may be connected to a line in set of lines 104 such that the line is maintained at a desired height. In other words, the connector may be connected to the line in a manner that supports the line rather than the line being secured to the connector. In these illustrative examples, the desired distance may be about 15 inches to about 15.5 inches.

With this type of connection, the line may move relative to the connector. This relative movement may occur when actuator 110 moves to change tension 108 in set of lines 104.

In these illustrative examples, set of spacers 114 may shape net 102 when tension 108 is present to provide space 119 between sides 121 of net 102. Space 119 may be a channel in which tennis balls may be caught. Set of spacers 114, in conjunction with tension 108 on set of lines 104, may result in net 102 having shape 120. Shape 120 may be a U-shape, a V-shape, or any other suitable shape that may result from tension 108 on set of lines 104. In these illustrative examples, set of spacers 114 is set of rods 122. These rods may be made of various materials. For example, without limitation, the rods may be made of plastic, fiberglass, a composite material, aluminum, wood, steel, and/or other suitable materials.

Tennis ball management system 100 also may include ball channeling system 124. Ball channeling system 124, in these illustrative examples, is configured to allow a ball caught by net 102 to roll towards an end of net 102. Ball channeling system 124 may comprise set of elongate members 126. These elongate members may be formed from different materials. For example, set of elongate members 126 may have a material selected from one of plastic, wood, aluminum, steel, and other suitable materials.

In this illustrative example, elongate member 128 in set of elongate members 126 has channel 130. Channel 130 is an open channel in surface 132 of elongate member 128. In other words, a ball may fit into channel 130 from surface 132 of elongate member 128. Channel 130 also may be referred to as a raceway, a gutter, or a trough.

Elongate member 128 is oriented such that a ball falling into channel 130 of elongate member 128 rolls towards an end of net 102. In other words, the ball rolls away from the center of the net in these illustrative examples.

Elongate member 128 may be connected to a portion of set of rods 122. Elongate member 128 may have a height of about 12.5 inches at around the center of net 102.

In this manner, tennis ball management system 100 may reduce the number of balls that may roll away from a tennis net on a tennis court towards a player or other person on the tennis court. With tennis ball management system 100, additional personnel used to remove tennis balls may be reduced. Further, the need for interrupting a game or a practice session also may be reduced with the use of tennis ball management system 100.

The illustration of tennis ball management system 100 in FIG. 1 is not meant to imply physical or architectural limitations to the manner in which an illustrative embodiment may be implemented. Other components in addition to and/or in place of the ones illustrated may be used. Some components may be unnecessary. Also, the blocks are presented to illustrate some functional components. One or more of these blocks may be combined and/or divided into different blocks when implemented in an advantageous embodiment.

For example, in some illustrative examples, an additional actuator in addition to actuator 110 may be present. In still other illustrative examples, actuator 110 and set of connectors 112 may be connected to posts or support structures other than the posts used to hold the tennis net.

Figure 2:
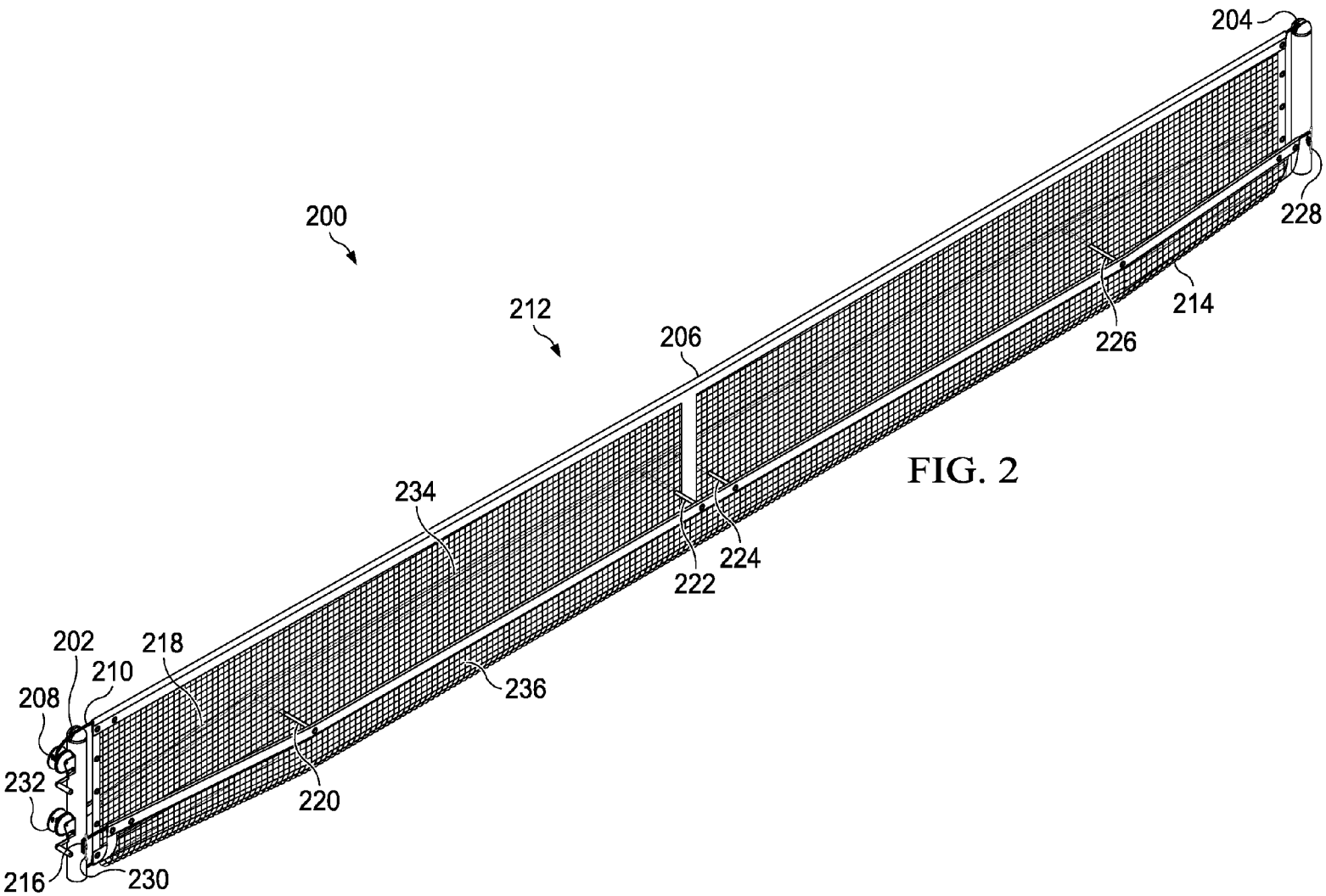
FIG. 2 is an illustration of a tennis court with a tennis ball management system in accordance with an advantageous embodiment.

With reference now to FIG. 2, an illustration of a tennis court with a tennis ball management system is depicted in accordance with an advantageous embodiment. In this illustrative example, tennis court 200 has post 202 and post 204. Tennis net 206 is connected to post 202 and post 204. Actuator 208 is connected to post 202 and to line 210. Line 210 is also connected to post 204. Actuator 208 may pull on line 210 to support tennis net 206 at a desired height.

In this illustrative example, tennis ball management system 212 is one example of a physical implementation of tennis ball management system 100 shown in block form in FIG. 1. In this illustrative example, tennis ball management system 212 includes net 214, line 216, line 218, rod 220, rod 222, rod 224, rod 226, connector 228, connector 230, and actuator 232.

Rod 220, rod 222, rod 224, and rod 226 may have different lengths or may have the same length with respect to each other. The selected length depends on the configuration desired for net 214. In this illustrative example, these rods may be made from fiberglass. The length of these rods may be, for example, about 0.5 inches in diameter and about 15 inches long. In this illustrative example, the desired height may be about 12.5 inches.

Two more connectors opposite to connector 228 and connector 230 may be present. These connectors are not seen in this view. These connecters may be made from various materials. For example, these connectors may be made from metal, aluminum, steel, plastic, or other materials suitable for connection to line 216 and line 218.

In this illustrative example, actuator 232 is connected to post 202 and is also connected to line 216 and line 218. Connector 228 is connected to post 204 and connector 230 is connected to post 202. These two connectors are at the same height in these illustrative examples. Connector 228 is connected to line 216 in a manner to secure line 216 to connector 228 at post 204. Connector 230 is connected to line 216 in a manner to maintain the height of line 216 at a desired height. In other words, line 216 may move relative to connector 230 when actuator 232 is moved. Two additional connectors (not shown) are connected to line 218 in a similar fashion.

Actuator 232 is configured to pull line 216 and line 218 to change a tension in these lines to place net 214 into a desired configuration. In these illustrative examples, the configuration is a U-shape, a V-shape, or some other suitable type of shape such that side 234 and side 236 of net 214 have a desired distance from tennis net 206. This desired distance is one that may allow a tennis ball hitting tennis net 206 to be caught by net 214. The distance may lessen towards post 202 and post 204 in these illustrative examples. Of course, other suitable distances may be used between the sides depending on the particular implementation.

As a result, the tennis ball does not roll on tennis court 200 away from tennis net 206. In other words, net 214 forms a channel, a trough, or a gutter to catch tennis balls.

Figure 3:
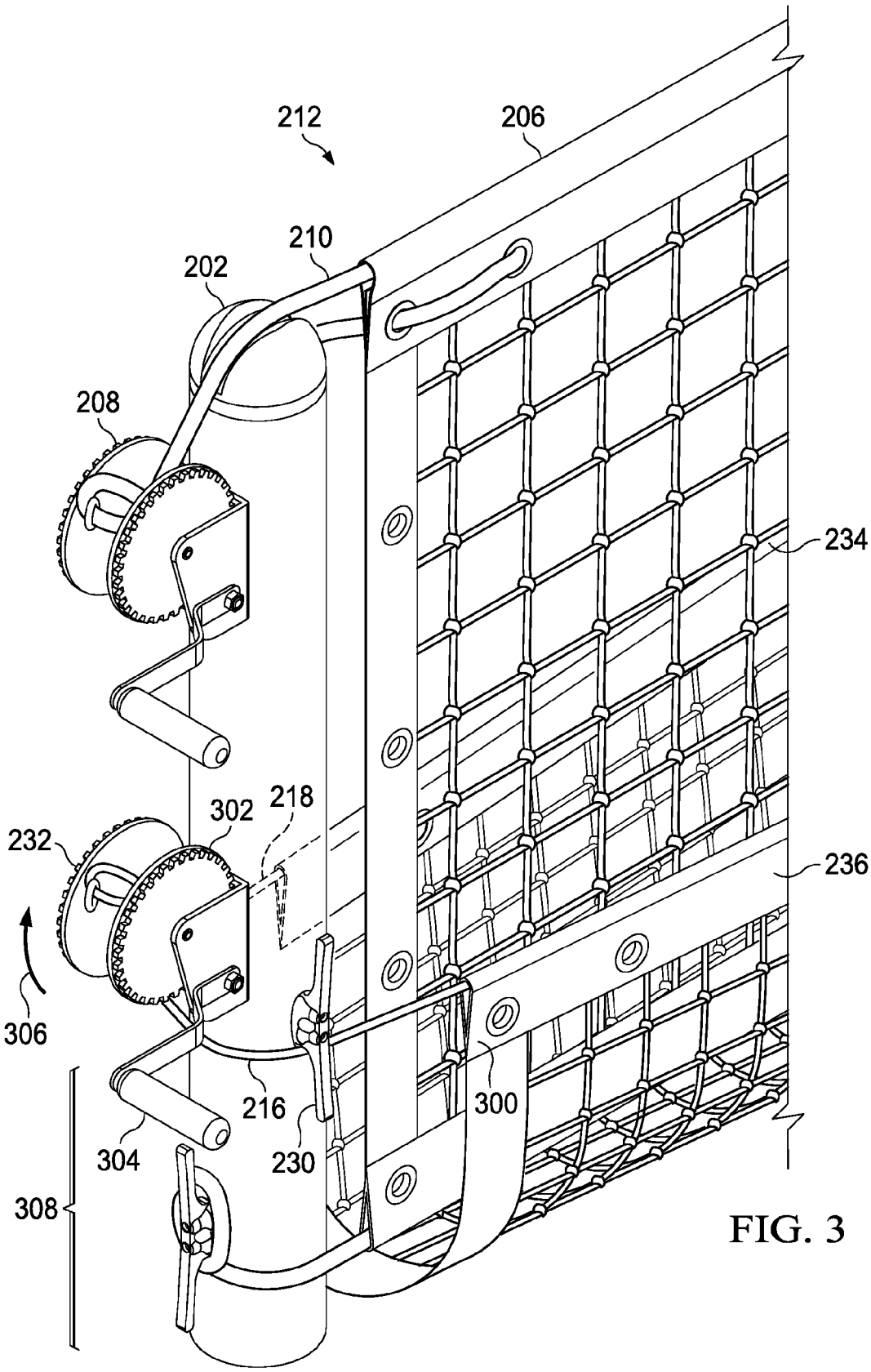
FIG. 3 is a more detailed illustration of lines connected to an actuator in accordance with an illustrative embodiment.

With reference now to FIG. 3, a more detailed illustration of lines connected to an actuator is depicted in accordance with an illustrative embodiment. In this particular example, actuator 232 and its connection to line 216 and line 218 are depicted in more detail.

In these depicted examples, line 216 extends through sleeve 300 and around connector 230 to rotatable member 302 of actuator 232. Line 216 is moveable relative to connector 230 when actuator 232 moves to change the tension in line 216.

Rotatable member 302 may be rotated by turning handle 304 in these illustrative examples. By turning handle 304 in the direction of arrow 306, the tension in line 216 and line 218 may be increased. Rotating the handle in the opposite direction of arrow 306 may decrease tension in line 216 and line 218.

In these illustrative examples, connector 230 takes the form of a cleat. Connector 228 provides support to maintain line 216 at height 308 when actuator 232 is located at a different height. In this manner, the height of net 214 may be maintained at a desired height with the use of connector 230. Line 218 also is connected to actuator 232. The connector (not shown) to which line 218 is connected to also allows line 218 to move relative to this connector. This connector is on substantially the opposite side of post 202 with respect to connector 230.

Figure 4:
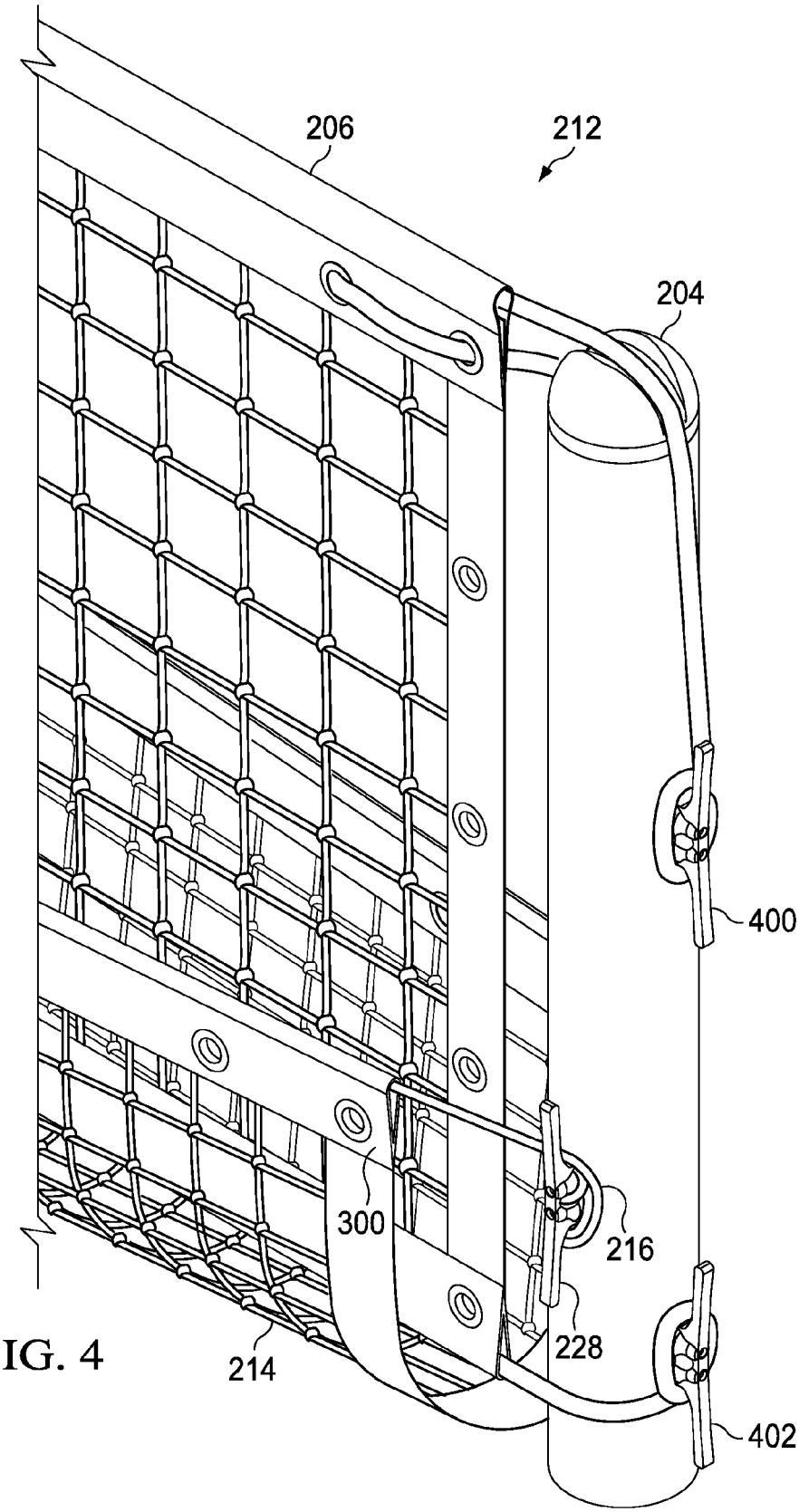
FIG. 4 is a more detailed illustration of a portion of a tennis ball management system in accordance with an advantageous embodiment.

Turning next to FIG. 4, a more detailed illustration of a portion of a tennis ball management system is depicted in accordance with an advantageous embodiment. In this depicted example, line 216 is secured to connector 228. In other words, line 216 does not move relative to connector 228 in this example. In this manner, when actuator 232 is rotated in the direction of arrow 306 in FIG. 3, tension increases in line 216. Tension in line 216 is decreased when actuator 232 is rotated in the opposite direction of arrow 306.

Connector 400 and connector 402 are also seen on post 204. These connectors are used to secure tennis net 206 and are not part of tennis ball management system 212 in this example.

Figure 5:
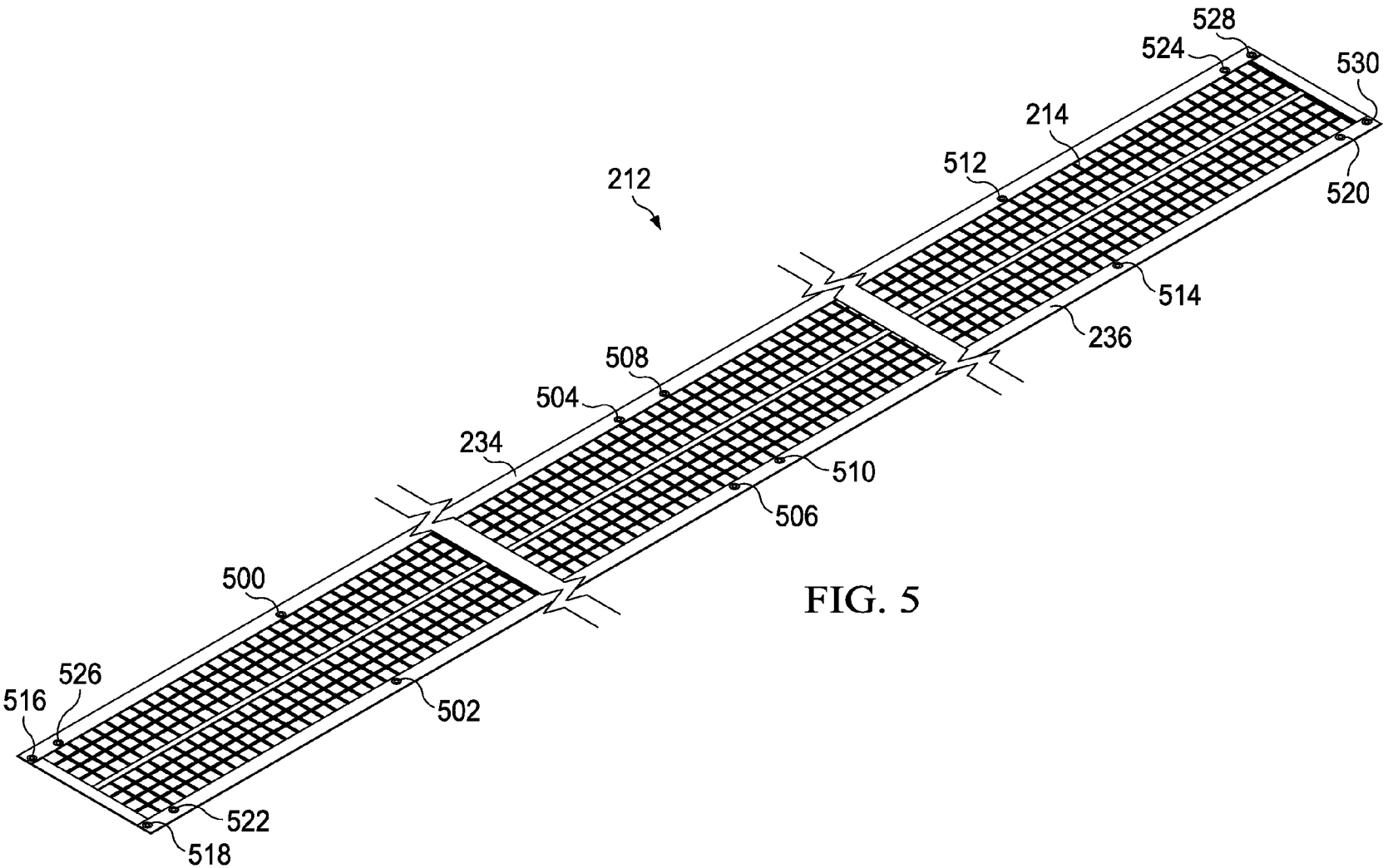
FIG. 5 is an illustration of a net for a tennis ball management system in accordance with an advantageous embodiment.

With reference now to FIG. 5, an illustration of a net for a tennis ball management system is depicted in accordance with an advantageous embodiment. In this illustrative example, net 214 for use in tennis ball management system 212 is shown in an un-configured form. In this illustrative example, net 214 has openings 500, 502, 504, 506, 508, 510, 512, and 514. These openings may be used to receive rods 220, 222, 224, and 226 as shown in FIG. 2. Openings 516, 518, 520, 522, 524, 526, 528, and 530 also are present in net 214 in this depicted example. The rods, however, are not depicted with these openings in this illustrative example.

Figure 6:
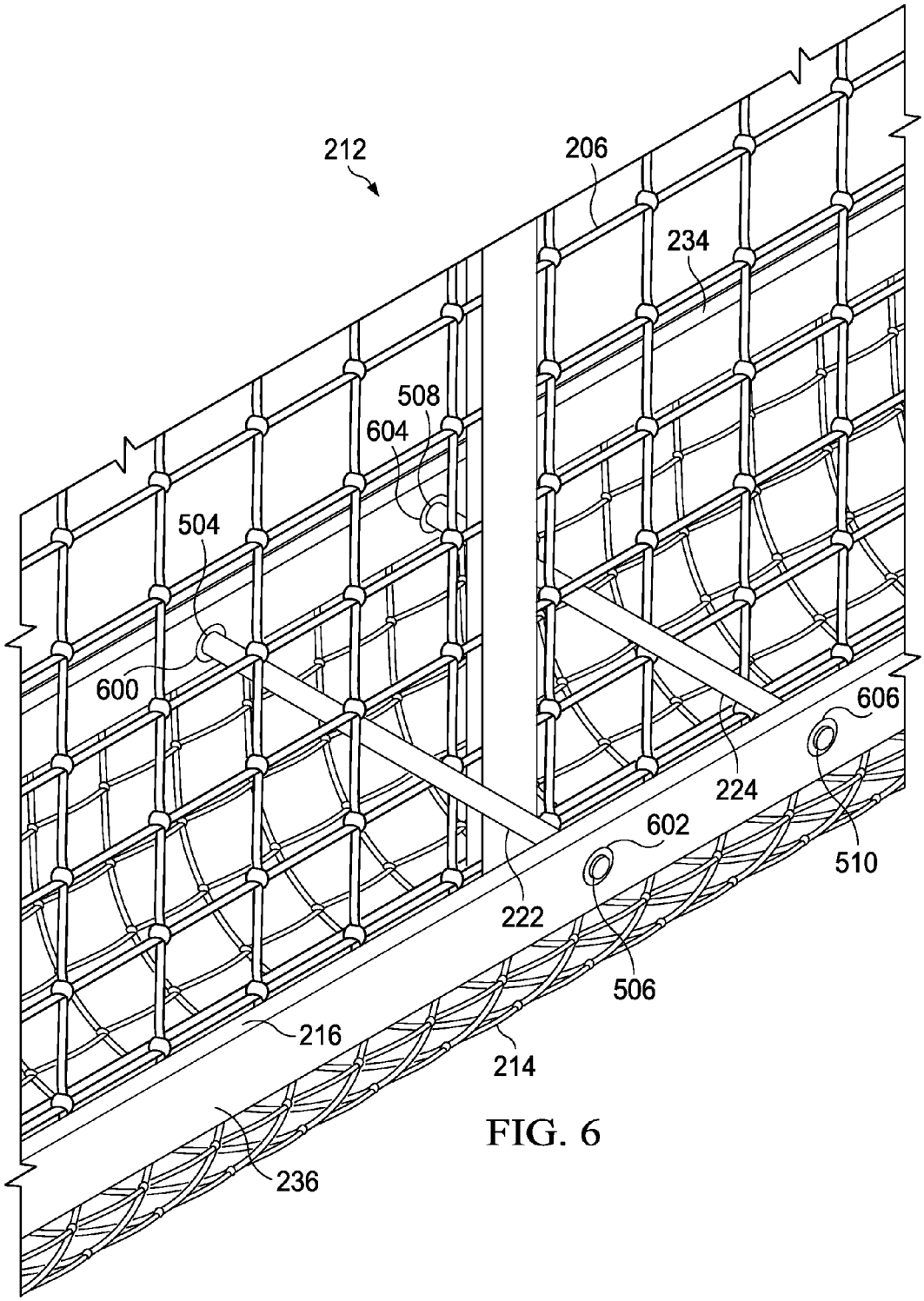
FIG. 6 is an illustration of rods in a tennis ball management system in accordance with an advantageous embodiment.

With reference now to FIG. 6, an illustration of rods in a tennis ball management system is depicted in accordance with an advantageous embodiment. In this example, rod 222 and rod 224 and their connection to openings 504, 506, 508, and 510 are shown in more detail. In these illustrative examples, when end 600 and end 602 of rod 222 engage opening 504 and opening 506, and when end 604 and end 606 of rod 224 engage opening 508 and opening 510, these ends engage the openings to maintain side 234 and side 236 of net 214 at a desired distance from each other.

In other words, these ends have a size and/or shape that do not allow the openings to slide through the length of the rods. The desired distance may be set by selecting the length of rod 222 and rod 224. These rods may be removable when tennis ball management system 212 is not in use. Further, different sized rods may be used depending on the particular implementation.

Figure 7:
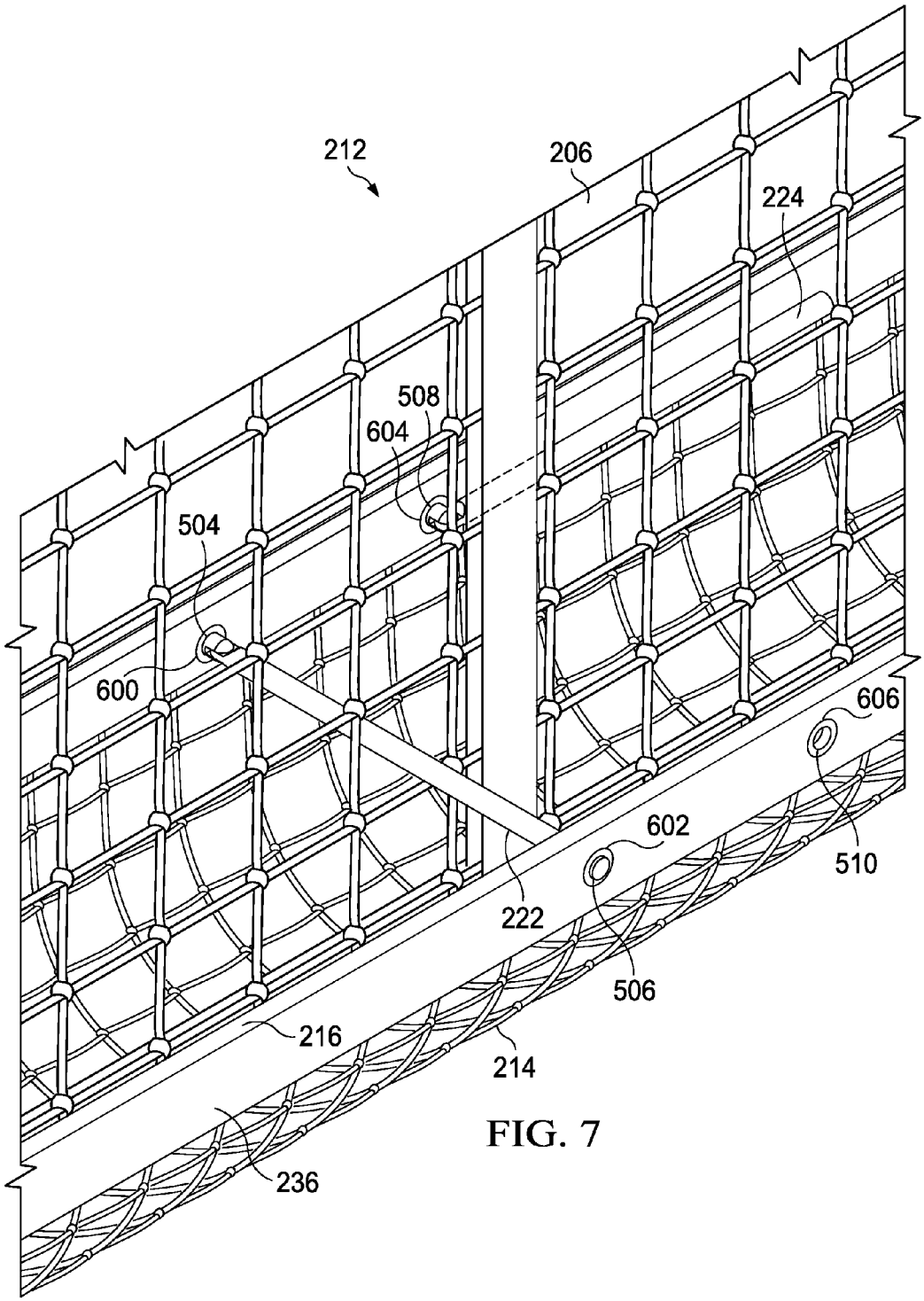
FIG. 7 is an illustration of rods in a tennis ball management system in accordance with an advantageous embodiment.

With reference now to FIG. 7, an illustration of rods in a tennis ball management system is depicted in accordance with an advantageous embodiment. In this illustrative example, end 600 of rod 222 is secured to opening 504 of net 214. In a similar fashion, end 604 of rod 224 is secured to opening 508 of net 214. Rod 222 and rod 224 both may be moved. In these examples, the rods may be moved to allow for easier disassembly of tennis ball management system 212. In this example, rod 224 is shown in a stowed position. In this manner, rod 224 does not need to be separated from net 214.

Figure 8:
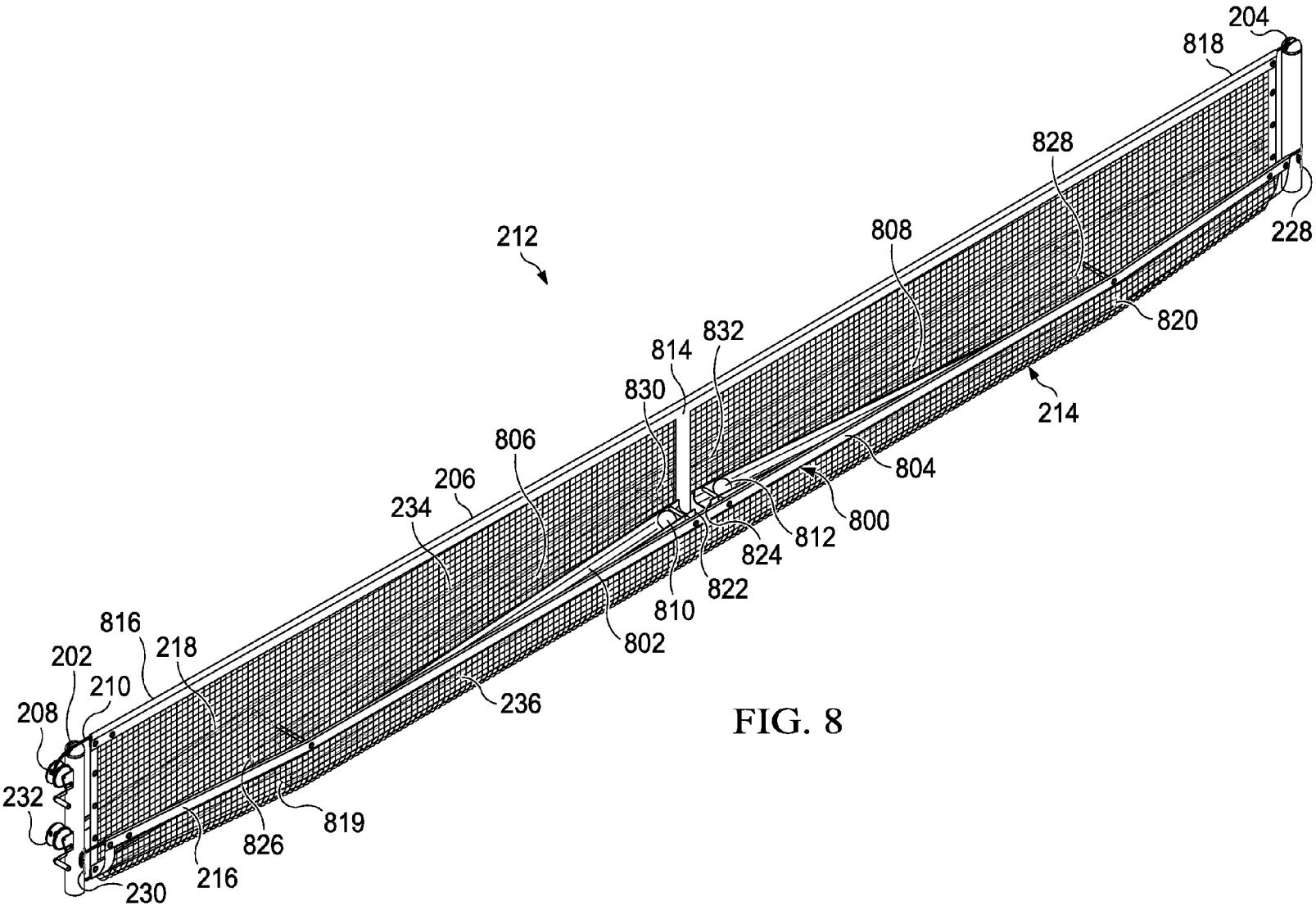
FIG. 8 is an illustration of a tennis ball management system with a ball channeling system in accordance with an illustrative embodiment.

Turning now to FIG. 8, an illustration of a tennis ball management system with a ball channeling system is depicted in accordance with an illustrative embodiment. In this illustrative example, ball channeling system 800 is included in tennis ball management system 212. As can be seen, ball channeling system 800 has elongate member 802, elongate member 804, elongate member 806, and elongate member 808. Elongate member 802 and elongate member 804 are between tennis net 206 and side 236 of net 214. Elongate member 806 and elongate member 808 are located between tennis net 206 and side 234 of net 214.

In these illustrative examples, these elongate members are positioned such that ball 810 and ball 812 will roll away from center 814 of tennis net 206 towards end 816 and end 818 of tennis net 206, respectively. In other words, end 819 of elongate member 802 and end 820 of elongate member 804 are lower than end 822 of elongate member 802 and end 824 of elongate member 804. In a similar fashion, end 826 of elongate member 806 and end 828 of elongate member 808 are lower than end 830 of elongate member 806 and end 832 of elongate member 808.

Figure 9:
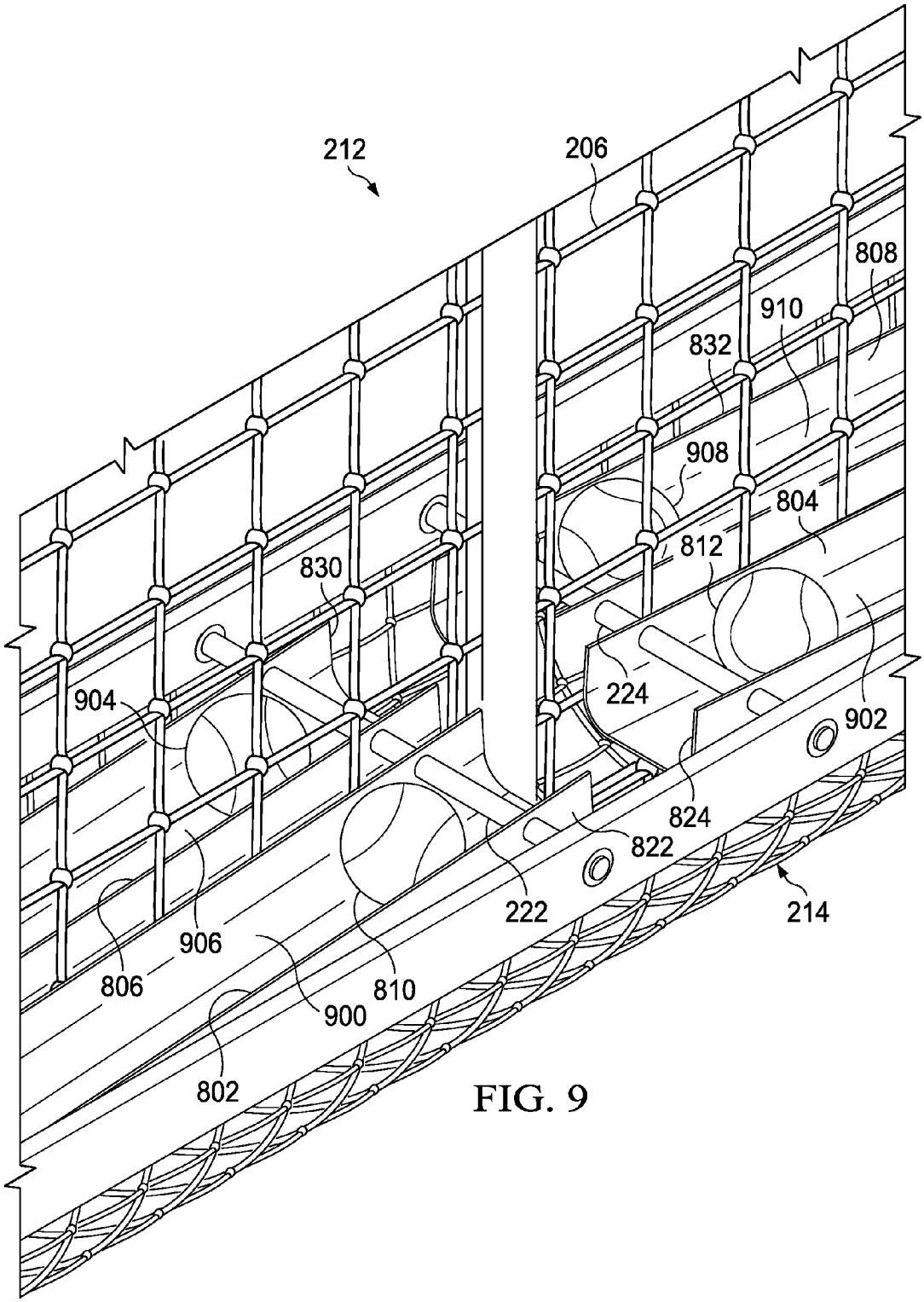
FIG. 9 is an illustration of a portion of a ball channeling system in accordance with an advantageous embodiment.

With reference now to FIG. 9, an illustration of a portion of a ball channeling system is depicted in accordance with an advantageous embodiment. In this illustrative example, a more detailed view of a portion of ball channeling system 800 in FIG. 8 is depicted. As can be seen in this example, end 822 of elongate member 802 and end 830 of elongate member 806 are connected to rod 222. In a similar fashion, end 832 of elongate member 808 and end 824 of elongate member 804 are connected to rod 224.

In this depicted example, ball 810 is shown as being located within channel 900 of elongate member 802, and ball 812 is shown as being located within channel 902 of elongate member 804. In this view, ball 904 is shown in channel 906 of elongate member 806 and ball 908 is shown within channel 910 of elongate member 808.

Figure 10:
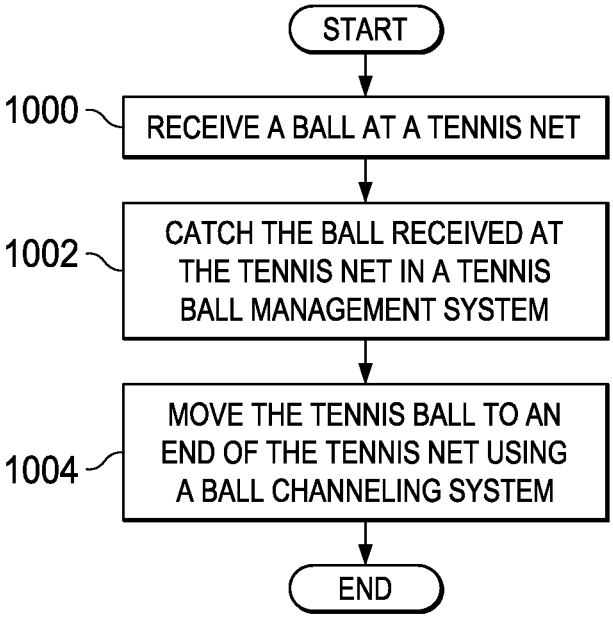
FIG. 10 is a diagram of a flowchart of a process for managing tennis balls in accordance with an illustrative embodiment.

With reference now to FIG. 10, a diagram of a flowchart of a process for managing tennis balls is depicted in accordance with an illustrative embodiment. The process illustrated in FIG. 10 may be implemented using tennis ball management system 100 in FIG. 1 on a tennis court such as tennis court 200 in FIG. 2.

This process may be used during game play and/or practice. The process begins by receiving a ball at a tennis net (step 1000). In step 1000, the tennis ball may be received by a player hitting a tennis ball that does not go over a tennis net. This may occur during practice or a game.

The process catches the ball received at the tennis net in a tennis ball management system (step 1002). The tennis ball management system may be tennis ball management system 100 in FIG. 1 and, in particular, may take a physical form as shown for tennis ball management system 212 in FIG. 2. The process may move the tennis ball to an end of the tennis net using a ball channeling system (step 1004), with the process terminating thereafter. This process may be repeated each time a tennis ball hits a tennis net when a tennis ball management system is in place.

The flowcharts and block diagrams in the different depicted embodiments illustrate the architecture, functionality, and operation of some possible implementations of apparatus and methods in an advantageous embodiment. In this regard, each block in the flowchart or block diagrams may represent a module, segment, function, and/or a portion of an operation or step.

In some alternative implementations of an advantageous embodiment, the function or functions noted in the block may occur out of the order noted in the figures. For example, in some cases, two blocks shown in succession may be executed substantially concurrently, or the blocks may sometimes be executed in the reverse order, depending upon the functionality involved. Also, other blocks may be added in addition to the illustrated blocks in a flowchart or block diagram.

For example, step 1004 may be omitted if a ball channeling system is not present in the tennis ball management system.

Thus, the different illustrative embodiments provide an apparatus for managing tennis balls. In the different examples depicted in the figures and described above, tennis balls that hit a tennis net may be managed in a manner that prevents or reduces the number of tennis balls that roll into an undesired location on the tennis court. With the use of the tennis ball management system, time and breaks in practice or game play needed to remove tennis balls may be reduced.

The description of the different advantageous embodiments has been presented for purposes of illustration and description, and is not intended to be exhaustive or limited to the embodiments in the form disclosed.

For example, rather than using two lines with each end of a line being connected to one of the posts on the tennis court, a single line may be used. The single line may extend from the first post to the second post, around the second post, and back to the first post. Connectors may be used to secure the line to the first post and to maintain the line at a desired height at the second post. The line may then be connected to the actuator.

Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

a net;

a set of lines associated with the net;

a support system configured to be connected to posts on a tennis court, be connected to the set of lines, and change a tension in the set of lines, wherein the net is configured to catch a tennis ball striking a tennis net on the tennis court when a desired amount of tension in the set of lines is present, and wherein the net has a channel with a U-shape;

the support system including a set of rods, wherein teach rod in the set of rods is configured to connect to a first side of the net and a second side of the net and maintain a desired amount of space between the first side of the net and the second side of the net when the desired amount of tension in the set of lines is present, and wherein a rod in the set of rods is connected to the first side by being movable attached to the first side;

a connector system configured to connect the set of lines to the posts, the connector system comprising a set of cleats; and a ball channeling system configured to allow the tennis ball caught by the net to roll towards an end of the net including a first elongate member with a first channel in a surface of the first elongate member and a second elongate member with a second channel in a surface of the second elongated member, wherein the first elongate member is located on a first side of the tennis net, wherein the first elongate member extends from a first location from a center of the net towards a first end of the net and is configured to allow the tennis ball to roll towards the first end of the net, wherein the second elongate member is located on the first side of the tennis net, wherein the second elongate member extends from a second location from the center of the net towards a second end of the net and is configured to allow the tennis ball to roll towards the second end of the net.

2. The apparatus of claim 1, wherein the support system comprises:

an actuator configured to be connected to the set of lines and create the desired amount of tension.

3. The apparatus of claim 2, wherein the actuator is a crank.

4. The apparatus of claim 3, wherein the posts are posts for the tennis net and the crank is connected to one of the posts for the tennis net.

5. The apparatus of claim 1, wherein a line in the set of lines is comprised of a material selected from metal, steel, nylon, and cloth.

6. A tennis ball management system comprising:

a net;

a set of lines associated with the net;

a crank configured to be connected to one of posts for a tennis net, be connected to the set of lines, and change a tension in the set of lines, wherein the net is configured to catch a tennis ball striking the tennis net connected to the posts on a tennis court when a desired amount of tension in the set of lines is present; and a set of rods, wherein each rod in the set of rods is configured to connect to a first side of the net and a second side of the net and maintain a desired amount of space between the first side of the net and the second side of the net when the desired amount of tension in the set of lines is present.

7. The tennis ball management system of claim 6 further comprising:

a ball channeling structure configured to allow the tennis ball in the channel to roll to an end of the net.

8. The tennis ball management system of claim 7, wherein the ball channeling structure comprises:

a first elongate member with a first channel located on a first side of the tennis net; and a second elongate member with a second channel located on a second side of the tennis net.

* * * * *